US005408701A

United States Patent [19]

Lemonnier et al.

[11] Patent Number: 5,408,701

[45] Date of Patent: Apr. 25, 1995

[54] SAFETY-AND-ARMING MECHANISM FOR AN EXPLOSIVE DEVICE

[75] Inventors: Georges Lemonnier, Arcay; Jean-Paul Duparc, Bourges; Jean-Pierre Dussol, Bourges; Gilles Rebeyrol, Bourges, all of France

[73] Assignee: GIAT Industries, France

[21] Appl. No.: 265,035

[22] Filed: Jun. 24, 1994

[30] Foreign Application Priority Data

Jun. 28, 1993 [FR] France ..... 93 07824

[51] Int. Cl.[6] ..... F42C 15/21; F42B 23/24

[52] U.S. Cl. ..... 102/258; 102/424

[58] Field of Search ..... 102/235, 245, 258, 259, 102/401, 424, 425

[56] References Cited

U.S. PATENT DOCUMENTS

| | | | |
|---|---|---|---|
| 2,960,037 | 11/1960 | Raech, Jr. et al. | 102/251 |
| 2,998,944 | 9/1961 | Rimmer | 244/14 |
| 3,279,374 | 10/1966 | Parker et al. | 102/81.6 |
| 3,451,306 | 6/1969 | Lagerstrom et al. | 89/1 |
| 3,662,607 | 5/1972 | Milanowski et al. | 74/2 |
| 4,667,600 | 5/1987 | Jensen et al. | 102/254 |

FOREIGN PATENT DOCUMENTS

| | | | |
|---|---|---|---|
| 2124908 | 9/1972 | France | F42B 13/00 |
| 2582799 | 12/1986 | France | F42C 15/00 |
| 2678724 | 1/1993 | France | 102/259 |
| 2685079 | 6/1993 | France | F42C 15/20 |

*Primary Examiner*—Charles T. Jordan
*Assistant Examiner*—Theresa M. Wesson
*Attorney, Agent, or Firm*—Parkhurst, Wendel & Rossi

[57] ABSTRACT

A safety-and-arming mechanism for explosive device having a body including a slider, at least one latch adapted to translate between first and second positions to block the slider and allow translation of the slider, respectively, and a biasing device for applying a constant force to the latch to urge the latch in the locking position. The biasing mechanism includes a blade disposed at an end of the latch, and the blade is adapted to provide the constant force due to pressing contact against an inside surface of a launcher tube for launching the explosive device. The blade is adapted to apply a substantially constant force to the latch despite changes in dimensional tolerances between the interior surface of the launcher tube and the explosive device.

7 Claims, 8 Drawing Sheets

SAFETY-AND-ARMING MECHANISM FOR AN EXPLOSIVE DEVICE

BACKGROUND OF THE INVENTION

The invention relates to safety-and-arming mechanisms for explosive devices such as mines, missiles and rockets which are launched from a launcher tube.

As a rule, the safety-and-arming mechanism of an explosive device of this kind comprises a primer-bearing slider locked by at least two independently driven latches. The latches may only move out of the way after some time after launching, and this feature entails sensing the sequence or time of ejection.

French Patent 85 08183 proposes a safety-and-arming mechanism for an explosive device such as a mine ejected by a launcher tube. This device comprises two latches of which one rests against the launcher tube. The manufacturing tolerances for the launcher tube, the explosive device and these constituent components are such that the latch length must not vary by several mm to operate properly.

This dispersion in tolerances entails the need to match each explosive device to its launcher tube. Accordingly, the latch length must be matched to the measurements carried out on each part entering the sequence of measurements. To mitigate the problem of custom-made latches, a set of latches with increasing lengths may be manufactured. However, this solution still requires measurements and having a stock of latches on hand. Therefore it is a very cumbersome matter to integrate the explosive devices into their launcher tubes and automation is precluded.

The object of the present invention is provision of a safety-and-arming mechanism fitted with a standard latch regardless of the manufacturing tolerances of the various parts of the explosive device and of the launcher tube.

Another object of the present invention is to assure a constant force on the latch of the safety-and-arming mechanism.

SUMMARY OF THE INVENTION

The invention provides a safety-and-arming mechanism for an explosive device such as a mine, rocket or missile launched from a launcher tube, comprising a primer-bearing slider held in place by at least one latch itself kept in place by an inner surface of the launcher tube and characterized in that it comprises a blade to be inserted between the launcher-tube inner surface and the latch by applying to this latch a substantially constant force so that the tube shall keep the latch in the slider's locked position, the blade being deformed beyond its elastic point without, however, exceeding its rupture strength when the mechanism is in place inside the launcher tube.

Advantageously, the blade comprises at least three bends of which a first one rests against the latch and the two other bends resting against the launcher-tube inner surface when the explosive device is inside the said launcher tube.

In another embodiment, the blade comprises at least five bends of which the first one rests against the latch, two other ones resting against the launcher-tube inner surface and the last two resting against the body of the explosive device when in place inside the launcher tube.

Preferably the blade shall be solidly joined to one of the sides of the explosive device.

In another embodiment relating to a mine-type explosive device fitted with stabilizer wings, the blade shall be rigidly joined to one of these wings.

BRIEF DESCRIPTION OF THE DRAWINGS

The invention is elucidated in the following description of preferred embodiments in relation to the attached drawings.

FIGS. *3a, 3b* show a blade of the safety-and-arming mechanism of the invention; FIG. *3a* being a side view of the blade subsequent to bending along the direction A of FIG. *3b;*

Figure 2:
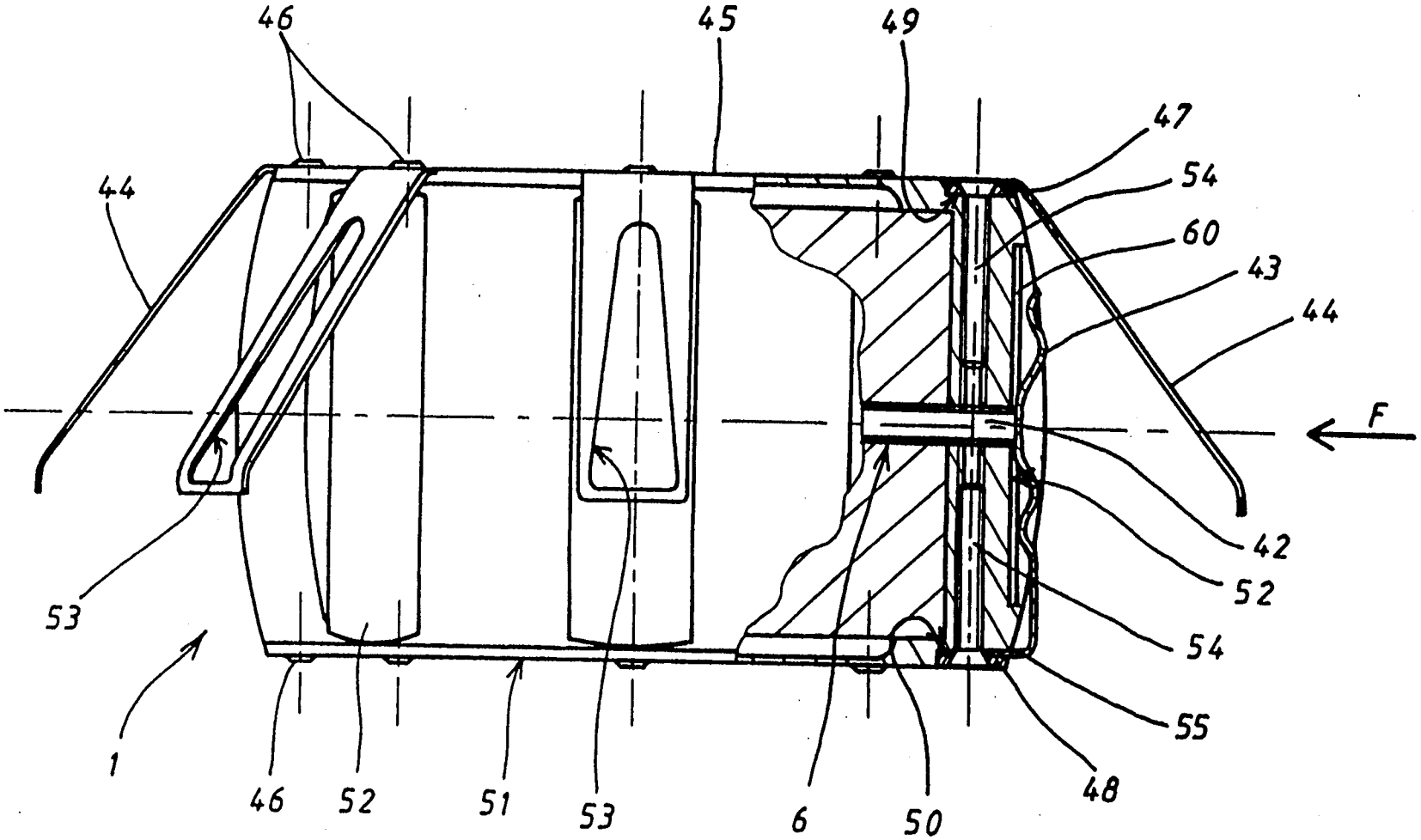
FIG. 2 is a schematic and partial section of a mine fitted with the safety-and-arming mechanism of FIG. 1.
Figure 4:
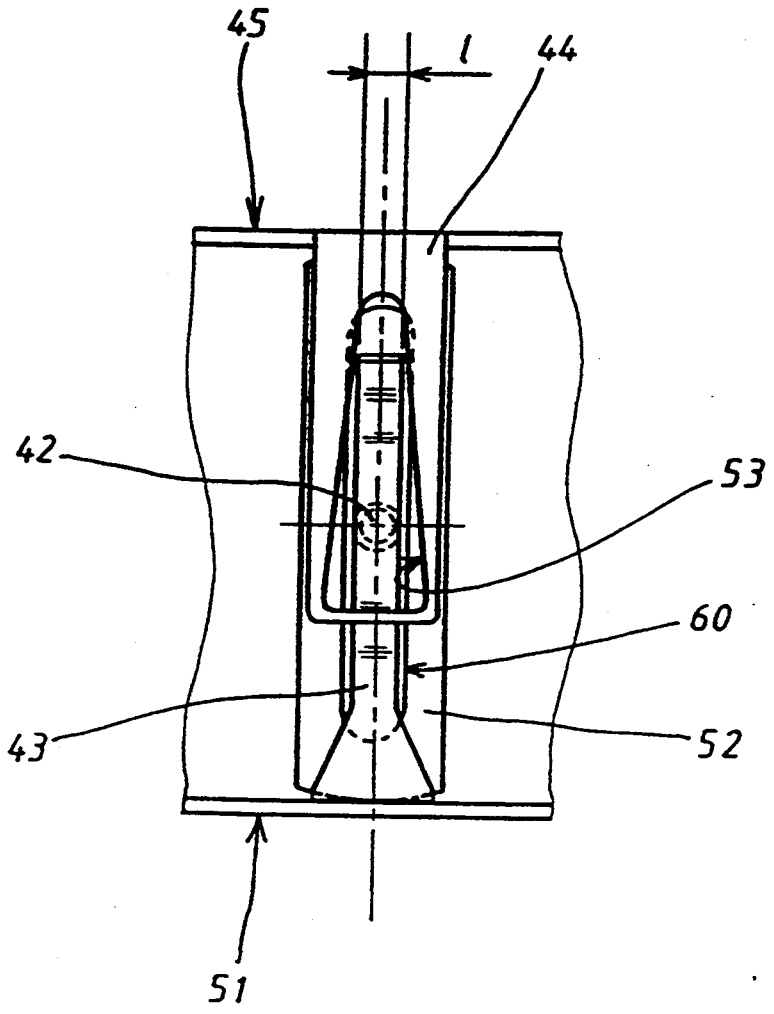
Figure 5:
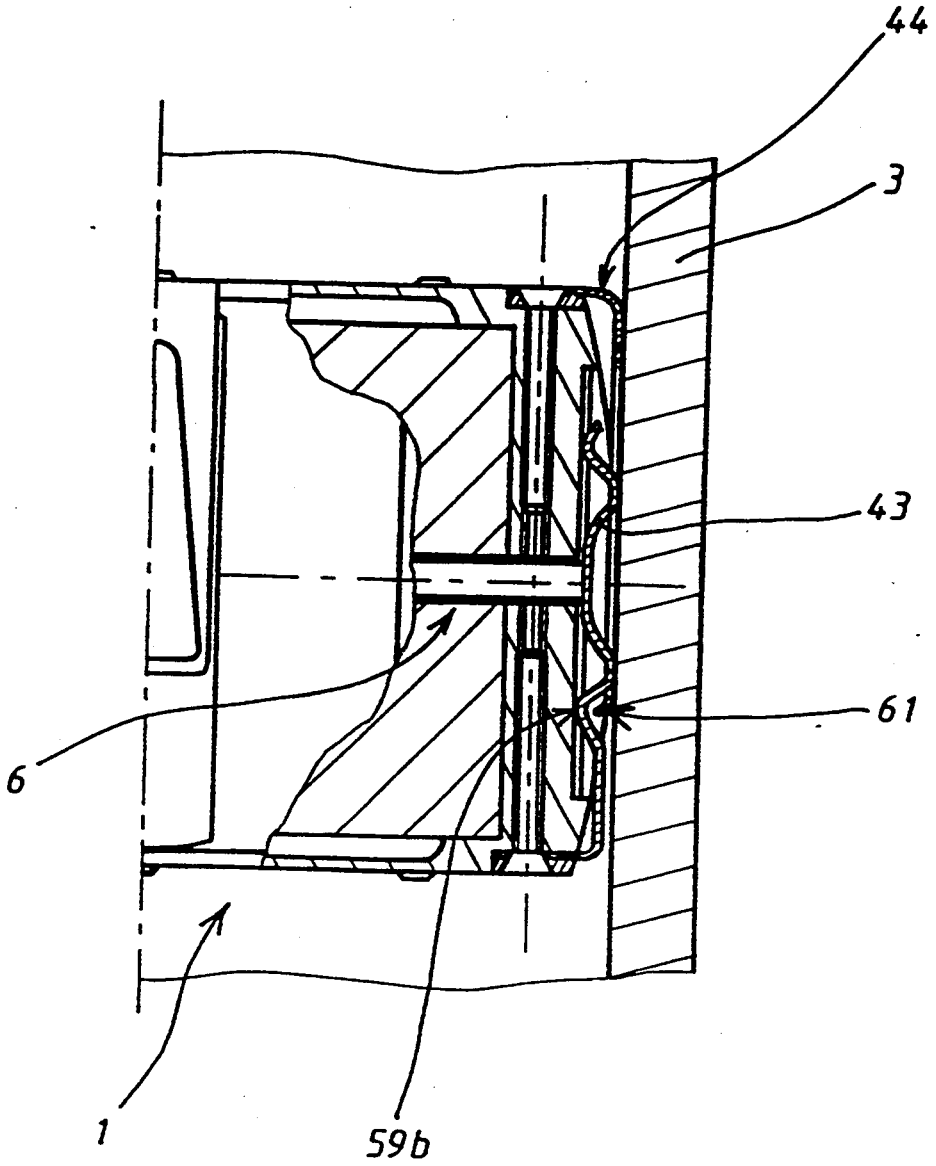
Figure 6:
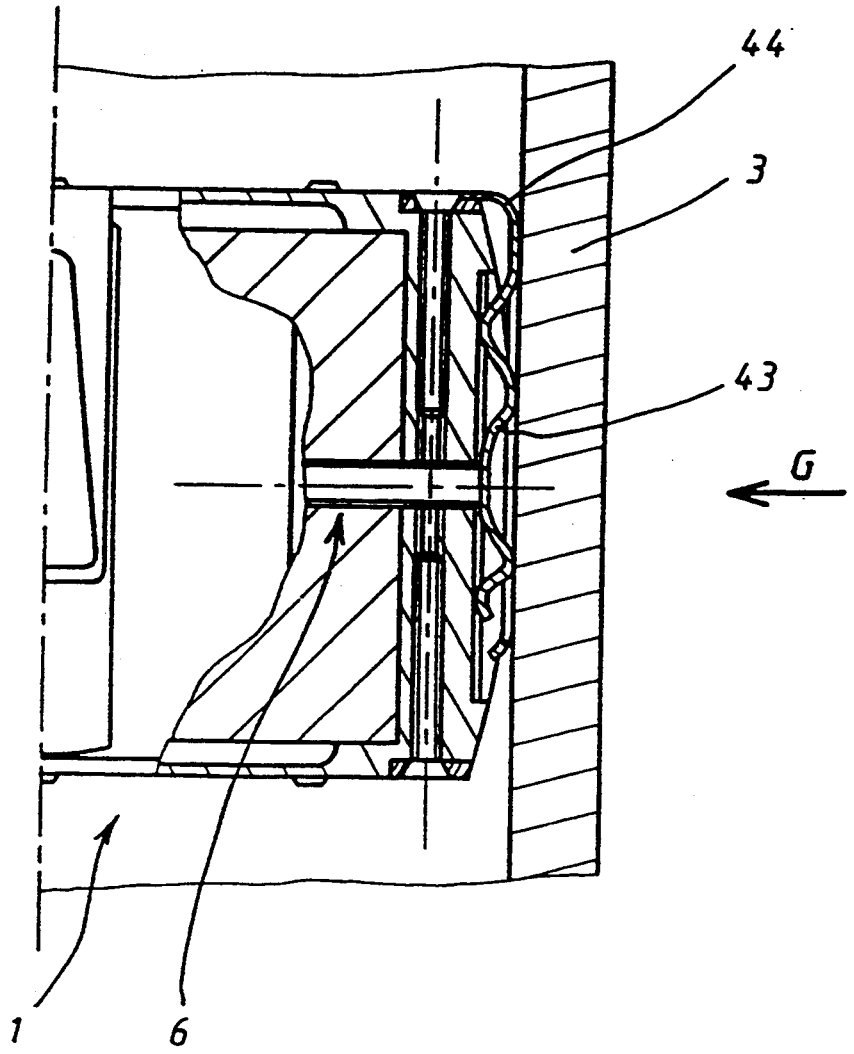
Figure 7:
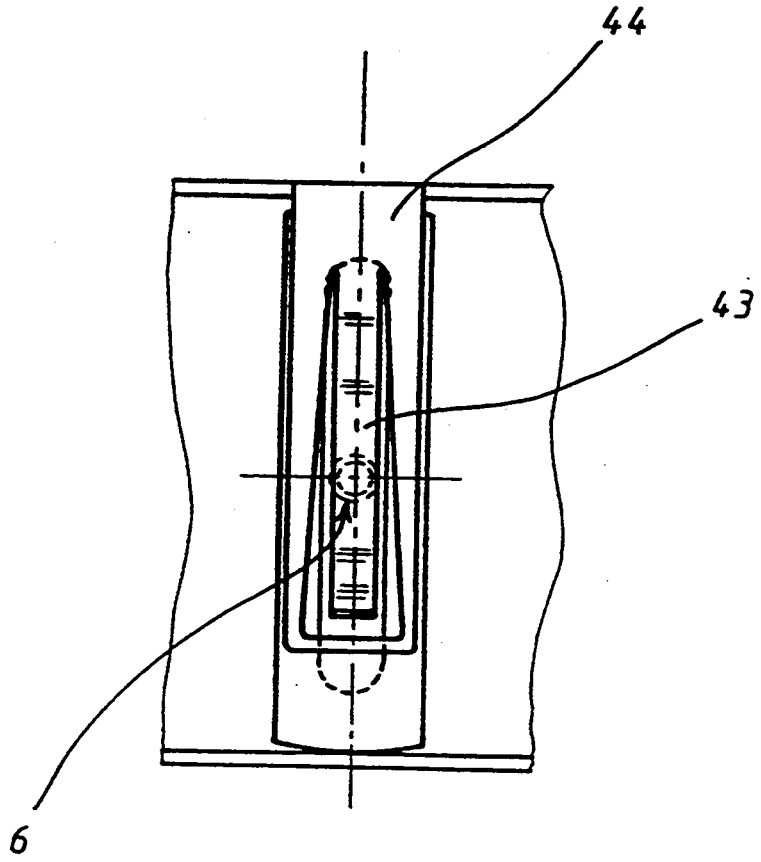

FIG. 4 is a partial view along direction F of FIG. 2;

FIG. 5 is a half-view of a mine in place inside its launcher tube;

FIG. 6 is a partial section of a mine fitted with a safety-and-arming mechanism of a second embodiment of the invention;

FIG. 7 is a partial view along direction G of FIG. 6; and

Figure 1:
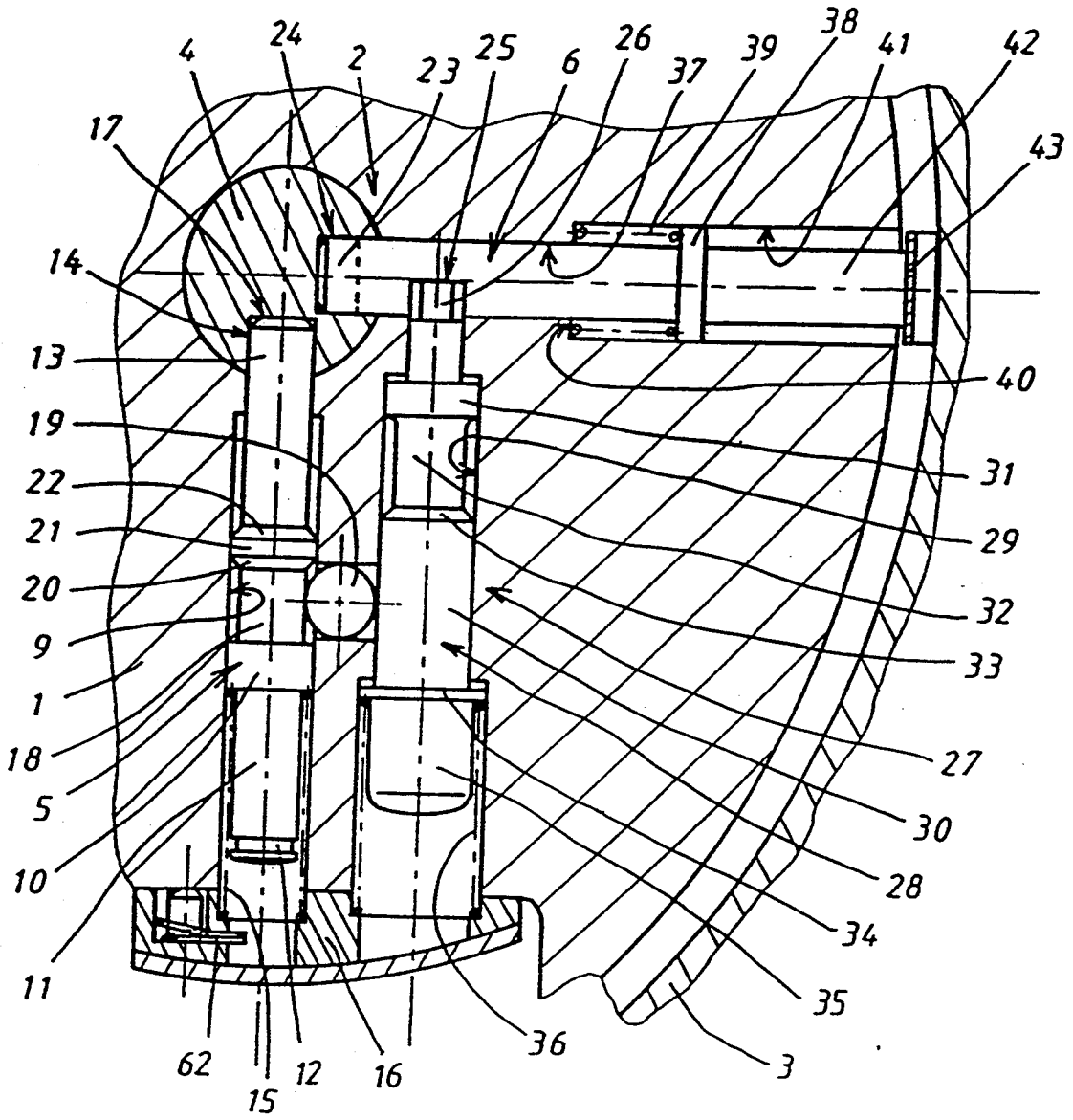
FIG. 1 is a schematic section of a safety-and-arming mechanism in the safety/storage position in a first embodiment of the invention.
Figure 8:
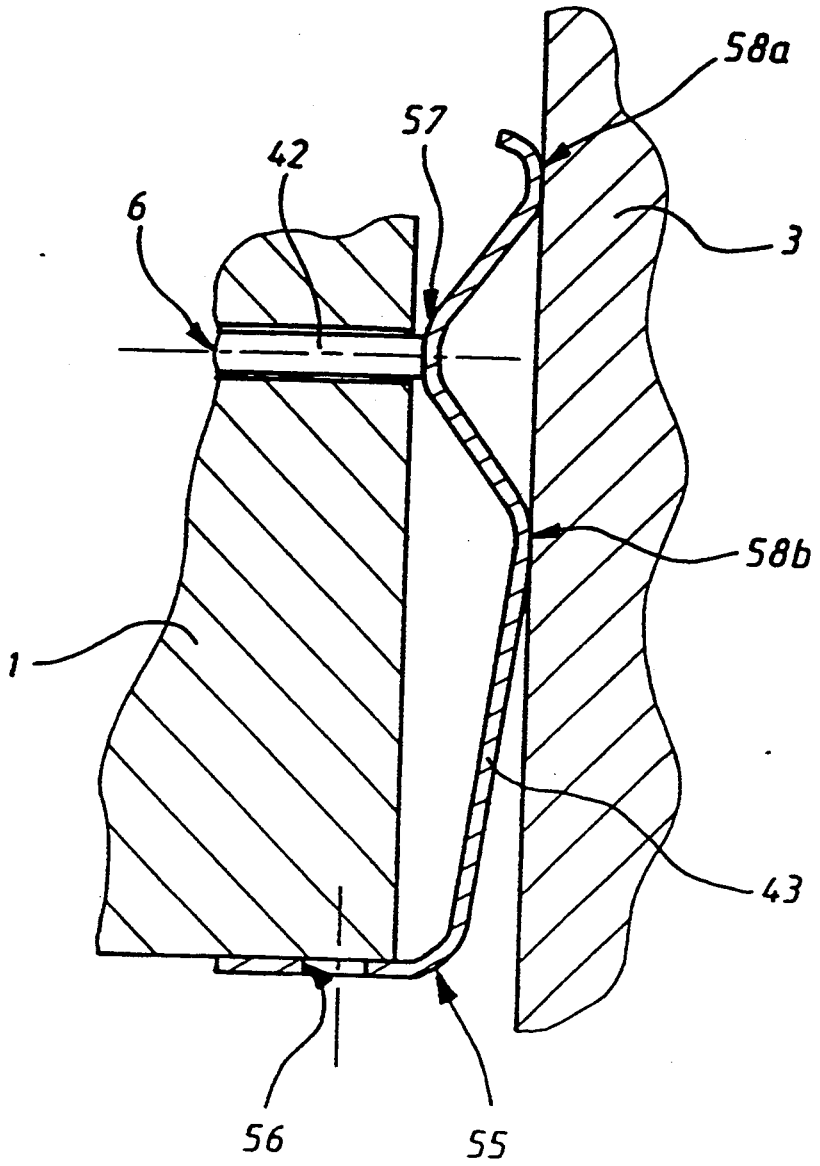

FIG. 8 schematically shows a section of the safety-and-arming mechanism of FIG. 1 of a third embodiment of the invention..

DETAILED DESCRIPTION OF PREFERRED EMBODIMENTS

FIG. 1 shows a section of an explosive device 1 in the zone of its safety-and-arming mechanism 2 inside a launcher tube 3. A primer-bearing slider 4 ensures in conventional manner that a pyrotechnic sequence (omitted) shall be interrupted. The slider 4 is held stationary by two latches 5 and 6 which are controlled independently of one another.

The latch 5 is slidingly mounted in a housing 9 in the body of the explosive device 1. The latch 5 comprises a body 10 with an outside diameter matching the inside diameter of the housing 9 and extended by a cylindrical rest 11 of a lesser diameter of which the end comprises a groove 12 to be discussed in further detail later.

The other end of the latch 5 has a diameter less than that of the housing 9 and enters a countersink 14 of the slider 4.

A helical spring 15 rests on one hand against the body 10 and on the other hand against a cover 16 rigidly joined to the body of the explosive device 1, forcing the latch 5 against the end 17 of the countersink 14.

The latch 5 furthermore comprises a constriction 18 against which rests a ball 19 and which is extended by a first frustoconical bearing 20 followed by a cylindrical guide segment 21 having the diameter of the housing 9 and by a second frustoconical bearing 22.

By its end 23 the latch 6 enters a countersink 24 of the slider 4. Near the slider 4 it comprises a groove 25 inside of which the end 26 of an intermediary locking means 27 will be seated. This intermediary locking means 27 comprises a stud 28 sliding in a housing 29 which is substantially parallel to the latch 5.

The stud 28 comprises a body 30 acting as a rest for the ball 19 and a cylindrical guide segment 31 of which the outside diameter corresponds substantially to the inside diameter of the housing 29.

The body 30 is linked to the cylindrical segment 31 by a constriction 32 and a frustoconical segment 33 cooperating with the ball 19. The stud 28 comprises a shoulder 34 and a cylindrical portion 35 in the extension of the body 30.

A helical spring 36 is guided by the cylindrical portion 35 and rests against the shoulder 34 and the cover 16, pushing the stud 28 against the base of the groove 25.

The latch 6 is slidingly mounted in a milling 37 of the body of the explosive device 1 and comprises a shoulder 38. A helical spring 39 is mounted between the shoulder 38 and a stop 40 of a housing 41 coaxial with the milling 37. The end 42 of the latch 6 is held in place by the inside surface of the launcher tube 3 by means of blade 43, discussed below.

The operation of a safety-and-arming mechanism of the invention illustratively part of a mine scattered on the terrain from a transport shell is as follows:

During the shell trajectory, the centrifugal force generated by shell rotation first causes the stud 28 to retract until it rests against the cover 16 and then initiates the retraction of the latch 5 which thereby forces the ball 19 against the constriction 32 of the stud 28. The latch 5 is trapped in the retracted position by an elastic pin 62 entering the groove 12.

During mine scattering from the transport shell, the blade 43 subject to the centrifugal force plastically deforms, thereby freeing the latch 6 which translates radially outwardly on account of the force exerted by the helical spring 39; the slider 4 thereby is totally unlocked and able to carry out any translational and/or rotational motion. The blade also may be dimensioned to rupture under the centrifugal force.

FIG. 2 shows an explosive device 1, illustratively a mine scattered by a transport shell. This mine 1 is fitted with a positioning means of the sort described in the French patent 92 14578 comprising angularly equidistant wings 44 (in this instance eight) of which one end is rigidly joined by strips 46 to one side of the mine 45.

The mine 1 furthermore comprises two metal washers 47 and 48 located in annular recesses 49 and 50 in sides 45 and 51, respectively. The strips 46 solidly affix the washers to the mine.

Each wing 44 comprises an aperture 53 and is able to fold back into a housing 52 in the body of the mine 1.

The partial section of FIG. 2 shows the end 42 of the latch 6, which is part of the above-described safety-and-arming mechanism 2, where the end 42 rests against the blade 43. The blade 43 is rigidly affixed by one of its ends 55 to the mine 1 in the vicinity of its side 51. On account of the presence of the latch 6, a strip is precluded and the affixation of the blade 43 and one of the wings 44 therefore is implemented by mounting screws 54.

Figure 3B:
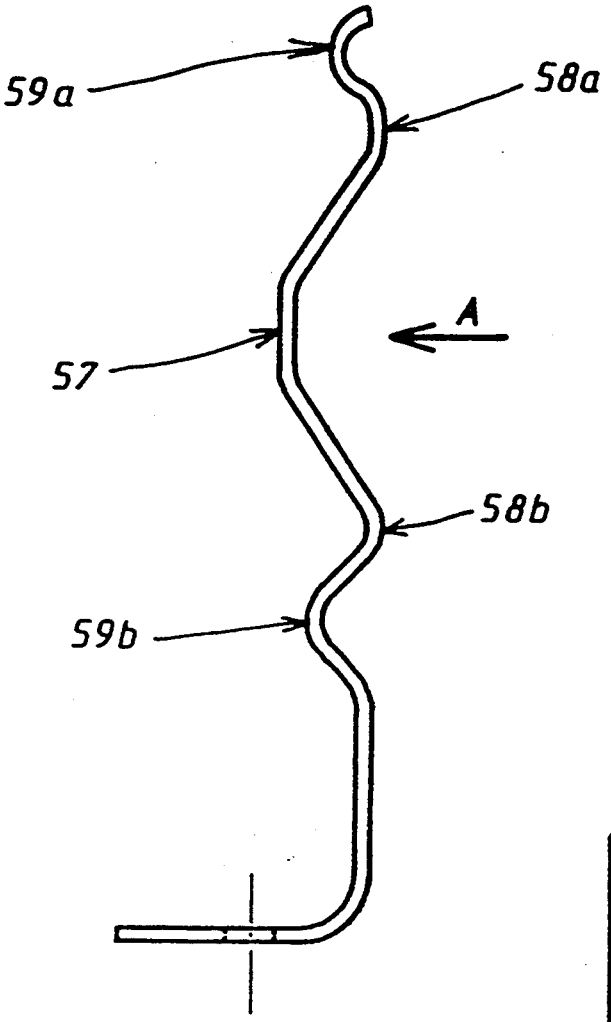
Figure 3A:
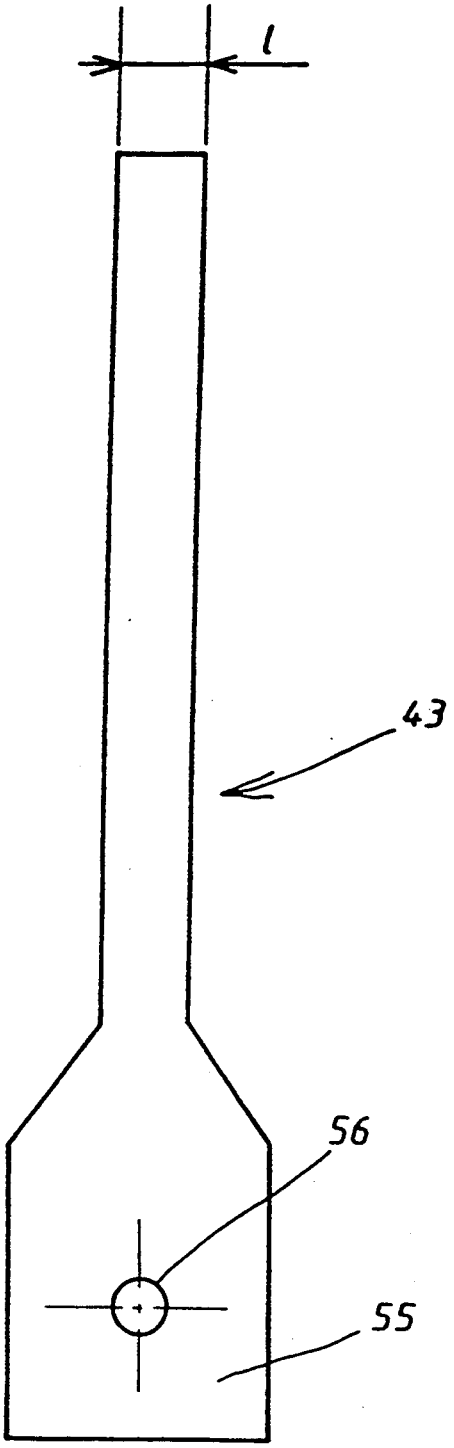

FIG. 3*a* shows the geometric development of the blade 43 prior to being bent. This blade 43 has a varying width. The end 55 comprises a hole 56 to pass the mounting screw 54.

FIG. 3*b* shows the blade after it has been bent and in the shape in which it will be mounted to the mine. It comprises several bends at its least width L.

The bend 57 rests against the end 42 of the latch 6 and comprises a planar surface somewhat larger than the diameter of the latch 6.

The two bends 58*a* and 58*b* shall make contact with the inner surface of the launcher tube 3 and are located symmetrically relative to the bend 57 to ensure perfect force distribution.

The arrangement of the bends serves to ensure that a force shall be applied to the end 42 of the latch 6 in the axial direction of the latch 6, thereby precluding latch jamming during loading of the explosive device in the tube launcher.

The last two bends 59*a* and 59*b* serve to press the blade against the body of the mine 1 near a groove 60 (FIG. 2) of which the purpose will be elucidated further below.

FIG. 4 is a partial view in the direction F of FIG. 2.

The width L of the blade 43 is less than the width of the aperture 53 of the wing 44 in order not to interfere with the strap when the mine is loaded into the transport shell.

The blade 43 will be laterally held in place when, by means of its bends 59*a* and 59b, it enters the groove 60, and as a result it cannot be warped by torsion as might be the case otherwise upon the transport shell being fired at very high angular acceleration.

FIG. 6 shows a partial section of a half-view of the mine in place in its tube launcher 3, the tube launcher in the case of a transport shell being its wall.

By inserting the mine 1 into the launcher tube 3, the blade 43 will be deformed. The force determined by the dimensions and the material of the blade 43 on the latch 6 is such that the elastic limit of the blade 43 shall be reached without however the mechanical rupture-strength being exceeded: the blade 43 therefore operates within its plastic range. As a result a constant force is applied to the latch 6 and allows compensating any substantial shifts in dimensional tolerances.

The dimensions and the material of the blade 43 furthermore are determined in the light of the magnitude of the centrifugal force generated by the shell rotation. The centrifugal force may not deform the blade beyond its mechanical rupture-strength.

Accordingly, there no longer exists the need for any measurement and as a result the mines may henceforth be loaded in automated manner into the transport shell.

The material of the blade 43 shall be selected in such manner that there shall be a high ratio of the maximum rupture-strength $R_m$ to its spring characteristics $R_{p\,0.2}$ (practical spring characteristics at 20% defined in French standard NF 10002-1) and shall also have great elongation A. Illustratively the constituent material of the blade 43 may be the special steel 35 NCD 16 of the French standard NF A 35552.

The various bends are rounded rather than sharp-angled, as a result of which stress concentrations can be lessened to better spread the forces. Force spreading also is improved by the presence of the two bends 59*a* and 59*b* to which part of the forces generated during the insertion of the explosive device into the tube launcher are applied.

FIG. 5 shows that the bend 59*b* advantageously receives the end 61 of the wing 44.

In an equally valid variation, the blade 43 may be solidly affixed to a wing 44 in the manner shown by FIGS. 6 and 7.

The blade 43 is cut into the wing 44.

When the mines are scattered from the transport shell, the wings 44 open up and deform permanently while driving the blade 43 which in turn frees the latch 6.

FIG. 8 shows the safety-and-arming mechanism of FIG. 1 in a third embodiment mode of the invention.

The blade 43 is rigidly joined to the explosive device 1 for instance by a mounting screw (omitted) at a hole 56 in the end 55 of the blade 43.

The end 42 of the latch 6 rests against the blade 43 which will be stressed during the loading of the explosive device into the launcher tube 3.

The force on the latch 6 is determined by the dimensions and the material of the blade 43. The forces are such that the elastic limit of the blade shall be reached without thereby exceeding its mechanical rupture strength, the blade therefore operating in its plastic range. A constant force on the latch 6 is achieved thereby and allows compensating any significant shift in dimensional tolerances.

Accordingly, no measurements at all need be taken any longer.

The blade 43 comprises several bends; one bend 57 coming to rest against the end 42 of the latch 6, and two bends 58*a* and 58*b* which shall make contact with the inner surface of the launcher tube 3. The two bends 58*a* and 58*b* are located in substantially symmetrical manner relative to the bend 57 to ensure perfect force spreading.

The location of the bends will ensure that a force shall be applied to the end of the latch 6 in the axial direction of the latch, thereby preventing the latch jamming when the explosive device is inserted into the launcher tube. Force spreading is improved by the rounded shape of the bends averting stress concentrations.

The material of the blade 43 shall be selected in such manner that it will offer a high ratio of maximum mechanical rupture strength $R_m$ to its spring characteristics $R_{p\,0.2}$ (practical spring characteristics at 20% defined by the French standard NF EN 10002-1) as well as high elongation A. Illustratively the material used for the blade 43 is steel grade 35 NCD 16 of the French standard NF A 35552.

What is claimed is:

1. A safety-and-arming mechanism for an explosive device having a body, comprising:

a slider bearing a primer;

at least one latch which is slidable between a locking position to block translation of the slider and prevent arming of the explosive device, and an arming position to allow translation of the slider; and biasing means for applying a constant force to said latch to urge said latch in said locking position, said biasing means comprising a blade disposed at an end of the latch and being adapted to provide said constant force due to pressing contact against an inside surface of a launcher tube for launching the explosive device.

2. The safety-and-arming mechanism of claim 1, wherein said blade comprises a bent strip having at least three bends, a first bend resting against said end of the latch and second and third bends adapted for resting against the inner surface of the launcher tube.

3. The safety-and-arming mechanism of claim 2, wherein said blade comprises five bends including fourth and fifth bends which rest against the body of the explosive device.

4. The safety-and-arming mechanism of claim 1, wherein the blade is rigidly secured to a side surface of the explosive device.

5. An explosive device, comprising:

a body;

a slider bearing a primer slidingly disposed in a first orifice in said body;

at least one latch disposed in a second orifice of said body, said latch being axially slidable between a locking position to block translation of the slider and prevent arming of the explosive device, and an arming position to allow translation of the slider; and biasing means for applying a constant force to said latch to urge said latch in said locking position, said biasing means comprising a blade disposed at an end of said latch and being adapted to provide said constant force due to pressing contact against an inside surface of a launcher tube for launching the explosive device.

6. The explosive device of claim 5, further comprising a plurality of stabilizer wings secured to the body of the explosive device, said blade being rigidly secured to one of said wings.

7. The explosive device of claim 5, wherein said blade is received in a groove formed in an outer surface of the body, said groove preventing warping of the blade due to angular acceleration upon firing of the explosive device from a launcher tube.

* * * * *